United States Patent [19]

Vallis et al.

[11] 4,410,221

[45] Oct. 18, 1983

[54] TOILET ROLL DISPENSER

[75] Inventors: Paul J. Vallis, Kew; William H. Hall, Kooyong, both of Australia

[73] Assignee: Bowater-Scott Limited, Victoria, Australia

[21] Appl. No.: 257,868

[22] Filed: Apr. 27, 1981

[30] Foreign Application Priority Data

Apr. 29, 1980 [AU] Australia ..... PE3326

[51] Int. Cl.[3] ..... B65H 19/04

[52] U.S. Cl. ..... 312/39; 312/38; 242/55.3

[58] Field of Search ..... 312/39, 37, 38, 41; 242/55.3, 55.53

[56] References Cited

U.S. PATENT DOCUMENTS

| | | | |
|---|---|---|---|
| 1,050,539 | 1/1913 | Hendrick | 312/38 |
| 1,564,292 | 12/1925 | Steiner | 312/38 |
| 1,721,925 | 7/1929 | Steiner | 312/38 |
| 2,229,327 | 1/1941 | Hepner et al. | 312/38 |
| 2,307,994 | 1/1943 | Clemens . | |
| 2,311,521 | 2/1943 | Colburn | 312/37 |
| 2,839,346 | 6/1958 | Lawalin . | |
| 2,872,264 | 2/1959 | Nehring . | |
| 3,266,742 | 8/1966 | Pena | 312/39 |
| 3,284,014 | 11/1966 | Wiggins . | |
| 3,421,800 | 1/1969 | Brown | 312/39 |
| 3,484,052 | 12/1969 | Clarke . | |
| 3,754,719 | 8/1973 | Choy . | |
| 3,770,222 | 11/1973 | Jespersen . | |
| 4,034,924 | 7/1977 | Carlisle . | |
| 4,294,389 | 10/1981 | Falk et al. | 312/39 |
| 4,314,679 | 2/1982 | Paul et al. | 242/55.3 |

*Primary Examiner*—Victor N. Sakran
*Attorney, Agent, or Firm*—Keil & Witherspoon

[57] ABSTRACT

A tamper resistant dispenser for rolls (18) such as paper towels or toilet tissues comprising side walls 11 having apertures 24 and 25 for manipulating the rolls past the resilient obstruction 22 into the dispensing position adjacent the opening 14. The flanges 23 prevent internal rotation of rolls in the container and flanges 21 prevent removal of rolls 18 from the container. The braking indentations 27 prevent the rapid unwinding of the paper web from the rolls 18.

1 Claim, 1 Drawing Figure

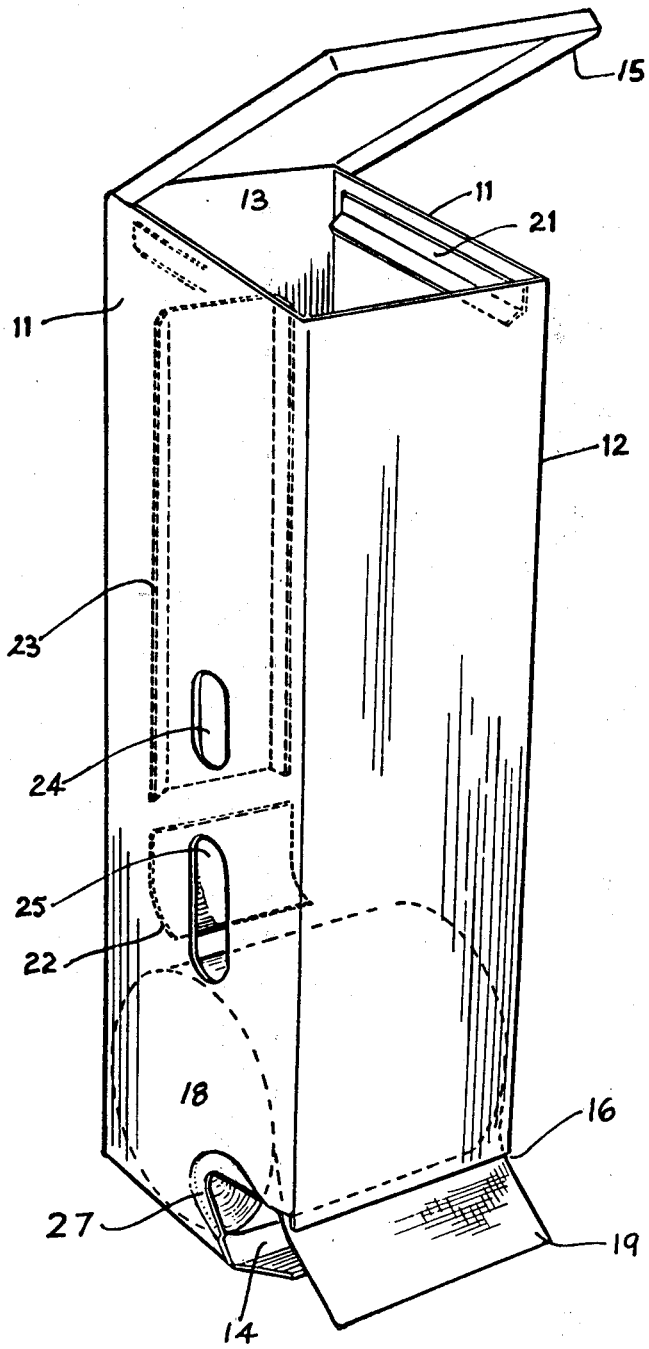
15
13
11
21
11
12
23
24
25
22
18
16
27
19
14

TOILET ROLL DISPENSER

This invention relates to a dispenser particularly one for material stored in roll form such as sheet material toilet rolls, paper towels etc.

In particular, this invention relates to an improvement in Australian the dispenser described in patent application No. 48247/79 which corresponds to U.S. Pat. No. 4,314,679 the disclosures of which are incorporated herein by reference.

That invention provided a roll holder comprising a container having a top end and a bottom end, there being at or adjacent the top end an aperture through which a roll can be inserted into the container, and at the bottom end an aperture through which a web of material can be withdrawn from a roll, the container having near its bottom end an impeding means for impeding the downward passage of a roll through the container, and a releasing means whereby a roll can be pushed passed the impeding means.

The width of each side wall of the container is slightly greater than the width of the roll for which the container is intended to be used. The width of the front wall is slightly greater than the length of the intended roll. At the top end of one of the side walls there is a circular aperture through which a roll can be inserted into the container.

The top opening is an aperture at the top of a side or front wall or in the top itself, with an angled inwardly extending flange at opposite sides of the aperture, so that a roll can be inserted into the aperture by pushing it between the flanges, but the angle of the flange being such that the roll cannot be withdrawn past the flanges. In other words, the aperture provides a one-way passage into the container, preventing unauthorised withdrawal of a roll from the container.

Although the above dispenser prevented inappropriate removal of the bottom most roll in a dispenser the upper rolls could be turned around and withdrawn sideways as no side flanges are present due to the lack of compressibility of most rolls in this dimension.

Another difficulty with the dispenser of No. 48247/79 was the possibility of deformation of the rolls when being pressed past the impeding means.

These difficulties are overcome in the present invention by providing a roll dispenser for sheet material stored by cylindrical rolls which comprises a container having a top and bottom end, side walls and front and rear walls, there being a roll inlet adjacent said top and the inlet opening carries an inwardly directed flange on at least one of the edges of said opening, and a sheet outlet at the bottom of said container for withdrawing sheet material from a roll within said container and said container incorporating a resilient impeding means located at least one roll diameter above said container bottom and one of said walls of said container incorporating an inwardly directed projection extending from above said impeding means toward the top of said container to prevent rotation of said rolls other than about the axis of said rolls.

Preferably the resilient impeding means comprises a piece of spring steel or metal plate secured at one end to one of the two sides of said container parallel to the axes of the rolls with the other end projecting downwardly into the interior of the container. In this arrangement a roll will be held above the impeding means until it is pressed down and past the impeding means. Once a roll is below the impeding means the angle of the spring makes it impossible to force it upwards past the metal plate. This contrasts with the fixed impedance provided in application No. 48247/79 which could not prevent a roll being foreced back beyond the impedance.

Preferably the projection in the upper part of the container is from one of the two sides of the container parallel to the axes of the rolls. This projection can be a formed metal plate secured or welded to the internal wall or can be a pressing from the wall itself extending inwardly. A preferred projection comprises a pair of vertically extending flanges inclined in opposite directions and abutting any rotational movement of the roll other than about the axis of the roll.

One embodiment of this invention is illustrated in the drawing.

The dispenser is for toilet rolls and is able to contain up to three full rolls. The dispenser consists of a near wall 13 a front wall 12 and side walls 11. A lid 15 is provided on the top of the container to close the opening which is used for inserting rolls. There is an outlet 14 at the bottom of the container. Roll 18 is illustrated in position for feeding out and the web 19 extends out through outlet 14. A serrated edge 16 is provided on the lower edge of front wall 12 to assist in severing the web 19.

The dispenser can be mounted by any suitable means fixed to the near wall 13 to a wall or column.

The features which ensure pilfer proofing of the present invention are the resilient impeding plate 22 the anti-twist channel member 23 and the side flanges 21. Once a roll is inserted fully into the dispenser the side flanges 21 impede removal. As indicated earlier the internal width of the dispenser (i.e. width of walls 12 and 13) must correspond closely to that of the rolls to be used and the maximum diameter of the rolls should likewise correspond to the internal depth of the dispenser (i.e. the width of side walls 11).

When a roll is located within the dispenser it normally seats on the resilient plate 22. In order to place the roll in its dispensing position it is gripped through the apertures 24 and 25 in side walls 11 and pushed past the resilient plate 22 into the position of roll 18. Once the roll has passed plate 22 it cannot be moved upwardly. To remove the roll 18 it must be unwound until its diameter is less than that of outlet aperture 14. Clearly the vertical height of aperture 14 corresponds to the diameter of the core of the roll 18. When the roll 18 is expended its core is removed through outlet 14 and a fresh roll is pushed into place.

The vertical channel member 23 prevents a roll from being twisted to be with its axis parallel to the side flanges 21. This ensures that without resorting to distortion or destruction of the dispenser rolls can not be improperly removed from its dispenser.

An additional and preferred feature is the brake indentations 27 in the side walls 11 adjacent outlet 14. Particularly where towel rolls are used a sudden pull of the web 19 will transmit a spinning motion to the roll 18 which will continue to unroll. When the roll is new and is near its maximum diameter, its mass and size tends to prevent this occurring. But as the roll is expended its mass and size decrease and the undesired unwinding of the roll is more likely to occur. However the indentations 27 which are adjacent the axis of the roll grip that portion tightly enough to retard spinning of the roll once the web 19 is ceased to be withdrawn. This provision avoids wastage of the roll content and ensures that there is sufficient tension in the web to achieve severance of the web along serrated edge 16.

An additional advantage of this invention is that because of the absence of a spindle to support the roll no janatorial labour is required in replacing rolls. Also there is virtually no liklihood of dispensers becoming empty as there is no need to wait for a spindle to become vacant. Rolls can be added to the dispenser on a regular basis and because they can only be used one at a time usage can be predicted more reliably.

We claim:

1. A dispenser for cylindrical rolls of sheet material comprising:

a body having a front wall, a rear wall, sidewalls, and a first and second end wall;

an inlet, for inserting rolls into the body, located in the first end of the body;

an aperture, located in the second end of the body, through which sheet material may be withdrawn;

a resilient impeding means comprising a downwardly directed resilient flange, located on the inner face of the rear wall at a distance of at least one but less than two roll diameters from the second end of the body; and means for preventing the removal of stored rolls from the inlet comprising two downwardly directed flanges, one on the inner face of each sidewall, located adjacent to the inlet, and an inwardly directed projecting means incorporated on the rear wall, extending from above the downwardly directed resilient flange to below the two downwardly directed flanges on the sidewalls to prevent twisting and removal of said stored cylindrical rolls of sheet material from the dispenser.

* * * * *